United States Patent [19]

Graf

[11] 4,356,597

[45] Nov. 2, 1982

[54] CARD CLOTHING INTENDED TO BE MOUNTED TO FLATS OF A CARDING MACHINE

[75] Inventor: Ralph Graf, Freienbach, Switzerland

[73] Assignee: Graf & Cie A.G., Rapperswill, Switzerland

[21] Appl. No.: 196,284

[22] Filed: Oct. 10, 1980

[30] Foreign Application Priority Data

Jul. 16, 1980 [CH] Switzerland ..... 5463/80

[51] Int. Cl.[3] ..... D01G 15/24; D01G 15/84

[52] U.S. Cl. ..... 19/113; 19/114

[58] Field of Search ..... 19/102, 103, 104, 113, 19/114

[56] References Cited

U.S. PATENT DOCUMENTS

| | | | |
|---|---|---|---|
| 1,688,418 | 10/1928 | Hancock | 19/114 |
| 3,057,020 | 10/1962 | McLeod | 19/113 |
| 3,737,953 | 6/1973 | Bechtel | 19/113 |
| 3,793,677 | 2/1974 | Bechtel | 19/113 |
| 3,936,911 | 2/1976 | Roberts | 19/113 |
| 4,297,768 | 11/1981 | Löffler | 19/113 |

FOREIGN PATENT DOCUMENTS

| | | | |
|---|---|---|---|
| 1278045 | 6/1972 | United Kingdom | 19/113 |

*Primary Examiner*—Louis Rimrodt

*Attorney, Agent, or Firm*—Lane, Aitken, Kice & Kananen

[57] ABSTRACT

Every wire section provided with teeth of a plurality of card clothing wires is connected at both its ends by a welding to a carrier member. This carrier member is a base section of a U-shaped carrier member whereby a curvilinear extending section continues at both ends of the base section, which curvilinear sections lead into laterally extending leg sections. Every card clothing wire is welded to the curvilinear sections such that the face ends of every wire section is aligned with the outer surface of the weld beads and the outer surface with each leg section.

6 Claims, 6 Drawing Figures

CARD CLOTHING INTENDED TO BE MOUNTED TO FLATS OF A CARDING MACHINE

BACKGROUND OF THE INVENTION

1. Field of the Invention

The present invention relates to a card clothing intended to be mounted to the revolving flat of a revolving flat carding machine, comprising a plurality of wire sections of equal length provided with teeth and mounted onto a carrier member.

Carding machines of the textile industry are utilized for opening, combing and cleaning of fibers such as natural cotton fibers. To this end revolving flat cards are provided with a rotating drum, the jacket of which is provided with a card clothing. Such drum interacts with a plurality of flats comprising also a card clothing and which flats are moved relative to the rotating carding drum in the same direction as the direction of travel of the rotating drum, however at a different speed. Known flats comprise a carrier, which supports the card clothing. This may be either hook-like wire sections stapled into a flexible web made for instance out of a textile material or may be wire sections provided with teeth.

2. Description of the Prior Art

Known flats carrying a card clothing composed of a plurality of stiff wire sections are weblike carriers comprising a recess extending in the longitudinal direction thereof, in which recess the wire sections of the metal card clothing wires are inserted side by side. The connection between these metal wires and the bottom of mentioned recess has customarily been made by means of a bonding agent or alternatively in such cases where the carrier member has been formed of a plastics material the metal wires had been pressed into the carrier during the casting, the forming thereof. The carrier member is mounted to the flat proper by means of, for instance a bonding agent or by means of bracket-like structural members.

Because now mentioned recess seen in a direction laterally to the longitudinal extent of such weblike carrier obviously does not extend until the longitudinal edge of such web void or empty, respectively, spaces exist between adjoining flats, in which sections obviously no carding occurs. By such constructions, in which the carding wires are pressed into the plastic carrier or in such cases where a bonding agent is located between the wires and the floor of the recess, the alignment of the wire sections relative to their carrier is detrimentally influenced and insufficient because in both cases the wire sections are positioned initially on a resilient surface when inserting these sections into the recesses of the flats.

SUMMARY OF THE INVENTION

An object of the invention is to provide a card clothing intended to be mounted to the flats of a carding machine, in which no void spaces are present between adjoining flats.

A further object is to provide a card clothing having exactly aligned wire sections and which is simple in construction and design, economical to manufacture and dependable in use.

Now, in order to implement these and still further objects of the invention, which will become more readily apparent as the description proceeds, the card clothing of this development is manifested by the features that the carrier member comprises an elongated rolled iron profile, further that the width of said iron profile equals the length of said wire sections, and that each of said wire sections is welded at both its ends to the longitudinally extending edge areas of said iron profile.

According to a first preferred embodiment a plurality of such wire sections is welded to said edge areas of said iron profile by means of a common weld bead each extending along said ends of said wire sections. Thereby the section of each of said wire sections extending intermediate of said welded areas abuts directly said carrier member.

The carrier member itself may be a section of an iron profile having a bracket-like cross-sectional shape including a base section, two leg sections extending each laterally therefrom, which leg sections are connected each to said base section by means of a curvilinear extending section, whereby said carrier member is formed of said base section and said curvilinear sections.

Furthermore, the carrier member may be a section of an iron profile having a bracket-like cross-sectional shape including a base section, two leg sections extending each laterally therefrom, which leg sections are connected each to said base section by means of a curvilinear extending section, whereby said carrier member is connected to said base section and its longitudinal side edges are aligned with the outside surfaces of the leg sections of the bracket-shaped profile.

According to a further preferred embodiment the carrier member as well as the card clothing wire mounted thereupon are shaped curvilinearly such that a same distance exists between all tips of the teeth of the carding cylinder and of the tips of the teeth of the carding flats.

Due to above described constructions it is possible to obtain a higher number of tips of teeth (25% of more), which leads to an improved guiding of the fibers and to an improved separation of the fibers. The extent of the void space at the teeth located between adjoining flats can be reduced to a dimension equaling the distance proper between two adjoining flats. It is known that such void space has a detrimental influence on the carding action. Furthermore, a whirling and eddying of the air stream existing between the drum and the flats moving relatively thereto at a slower speed can be reduced. It is known that the stiff card clothing having wires with teeth result in a reduction of the filling capability. Preferred embodiments of the present invention may reduce this loss to several percent. This can be desirous specifically if staple fibers of natural or synethetic polymers must be handled.

BRIEF DESCRIPTION OF THE DRAWINGS

The present invention will be more fully understood by reference to the following detailed description thereof, when read in conjunction with the attached drawings, wherein.

DETAILED DESCRIPTION OF THE PREFERRED EMBODIMENT

Figure 1:
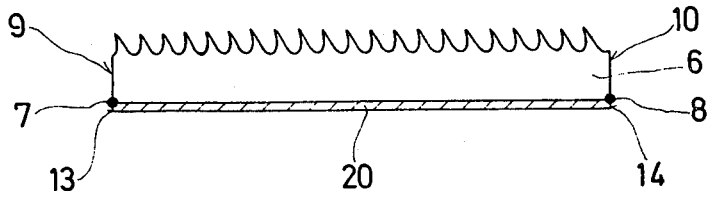
FIG. 1 is a view of an embodiment having a flat iron profile.

Firstly, describing now the drawings, and considering initially the exemplary embodiment as shown in FIG. 1, it will be understood that same comprises a carrier member having the shape of a rolled, flat iron profile section. A sawtooth wire section 6 is placed upon this carrier member 20, such that it abuts directly the carrier member 20. The two outermost ends of the sawtooth wire section 6 is welded by means of a welding 7, 8 each with the inner edges of the carrier member 20. Thereby the dimensions of the sawtooth wire 6 are chosen such, i.e. it comprises such a length that its two face ends 9, 10 are aligned with the ends of the carrier member 20. For manufacture, a plurality of sawtooth wire sections 6 are arranged package-wire on the carrier member 20. Thereupon all sawtooth wire sections 6 are connected each by means of a weld bead 7, 8 to the ends of the carrier member 20. According to an embodiment the outer sides of these weld beads 7, 8 may additionally be worked, filed or machined such that the longitudinal side faces 13, 14 of the carrier member 20 define a plane, in which there are located the face ends 9, 10 of the carrier member 20 as well as the outer side surfaces of the weld beads 7, 8. The carrier member 20 and the sawtooth wires 6, the so-called card clothing, can be connected in various ways to the flats proper of the carding machine. To this end, reference is drawn to the embodiments disclosed later as the description proceeds.

Figure 2:
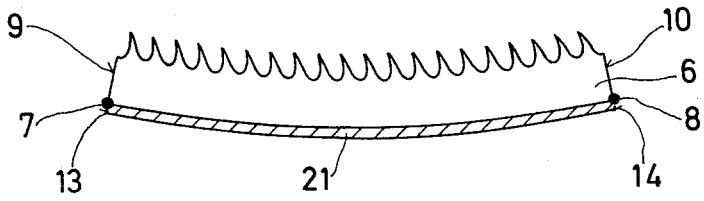
FIG. 2 is an embodiment having a curvilinearly extending iron profile.

In FIG. 2 there is shown a further embodiment. This embodiment differs from the embodiment shown in FIG. 1 insofar in that the carrier member 21 extends curvilinearly and accordingly, the sawtooth wire section 6 placed upon the concave side surface of the carrier member 21 extends likewise curvilinearly. Again, the face ends 9, 10 of the sawtooth wire section 6 are aligned with the longitudinal side faces 13, 14 of the carrier member. Also in this embodiment the sawtooth wire sections 6 are connected by the agency of weld beads 7, 8 with the carrier member 21. The flats of the carding machine operate together with the carding drum, such as has been described further above. Accordingly, the plane defined by the tips of the teeth of the sawtooth wire section 6 of FIG. 1 extends parallel to the tangents of the geometrical jacket defined by the tips of the teeth of the carding cylinder which follows in that differing distances are present between the tips of the teeth of the flats and the tips of the teeth of the carding cylinder whereagainst the embodiment shown in FIG. 2 follows in that all tips of the teeth have the same distance from each other which results obviously in an improved carding- and combing effect.

Figure 3:
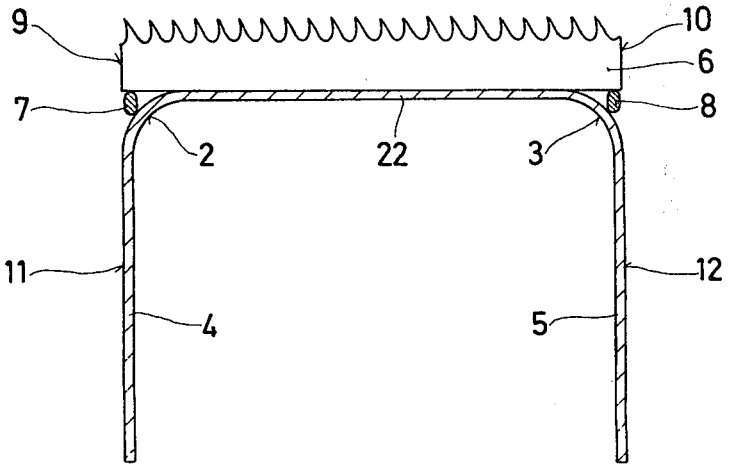
FIG. 3 is an embodiment having a bracket-shaped carrier.

In FIG. 3 there is disclosed an embodiment, according to which the carrier member 22 is a base section of an iron profile, which base section is bounded at both its ends by an arc-shaped or curvilinear, respectively, section 2, 3, followed each by a leg section 4, 5. The mounting of the bracket-like carrier comprising above described sections with a given flat is carried out, in that the ends of the leg sections 4, 5 are bent in a known way into recesses formed in the flats, such that the carrier is clamped to its flat. This procedure is well known to the person skilled in the art, forms no part of the present invention and accordingly, will not be described closer.

Upon the carrier member section 22 forming mentioned base section there is arranged each sawtooth wire section 6, such that it abuts directly said carrier member 22. The two outermost ends of every sawtooth wire section 6 is connected by means of a welding 7, 8 to the corresponding curvilinear section 2, 3. Again, it must be mentioned, that a plurality package-like arranged sawtooth wire sections 6 are present, which packages are connected by means of weld beads 7, 8 to the curvilinear sections 2, 3. The welding material of which these weld beads 7, 8 are formed is arranged such that it is aligned at its outside with the face ends 9, 10 of the sawtooth wire section 6, i.e. with all sawtooth wire sections 6 and is furthermore aligned also with the outer surfaces 11, 12 of the leg sections 4, 5. This arrangement allows again a smallest distance between the face ends 9, 10 of the sawtooth wire sections 6 of adjoining flats. No void spaces exist between adjoining flats such that in comparison with the prior art a highly improved carding and combing effect is attained, a feature of all embodiments described herein.

Figure 4:
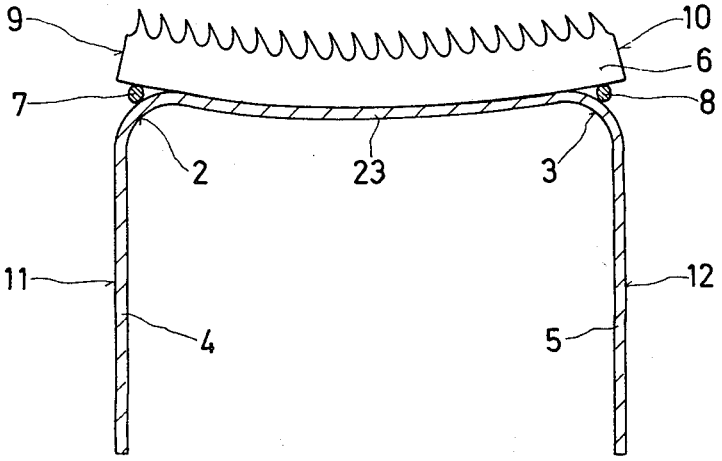
FIG. 4 is an embodiment having a bracket-shaped carrier including a curvilinearly extending base section.

The embodiment shown in FIG. 4 corresponds with regard to the arrangement of the carrier member 23 and of the sawtooth wire section 6 to the embodiment of FIG. 2 having the same technical advantages. The bracket-shaped carrier consists of the carrier member part 23 forming the base section of the bracket followed at both ends by the curvilinear sections 2 and 3, which themselves are followed by the leg sections 4 and 5. The weld beads 7, 8 which are arranged at the side of the face ends 9 and 10 of the sawtooth wire section 6 are located relative to the embodiment of FIG. 3 further inwards such that the sawtooth wire section 6 projects at both its face ends 9, 10 somewhat over the weld beads 7, 8; however, it does not project further out than the outer surfaces 11, 12 of the leg sections 4 and 5, such that again a minimal distance is formed.

Figure 5:
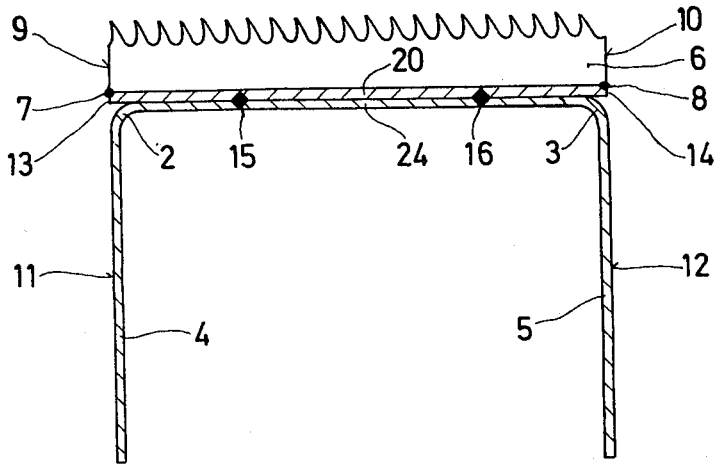
FIG. 5 is an embodiment having a flat iron profile connected to a bracket-shaped carrier.

In FIG. 5 there is shown a further embodiment. In this embodiment the sawtooth wire sections 6 (i.e. the package or packages, respectively, of sawtooth wire sections) are welded to a carrier member 20 having the form of a flat rolled iron profile. Again the location of the welds, i.e. of the weld beads 7, 8, (see FIG. 1) are at the face ends 9, 10 of every sawtooth wire section 6 and the longitudinal side faces 13, 14 of the carrier member 20, respectively. The carrier member 20 is in turn welded by means of weldings 15, 16 to an iron profile piece having a bracket-shaped cross-sectional area. Thereby the carrier member section 20 abuts flatly the base section 24 of the bracket. This base section 24 is followed at both ends by curvilinear sections 2, 3, which are followed by leg sections 4, 5 such as is the case in the embodiment shown in FIG. 3. Thereby the arrangement is chosen again such that the outer surfaces 11, 12 of the leg sections 4, 5 are aligned with the face ends 9, 10 of the sawtooth wire section 6 or packages of sawtooth wire section 6. Therewith there is formed a stronger, more rugged construction of the card clothing, specifically of the carrier member thereof.

Figure 6:
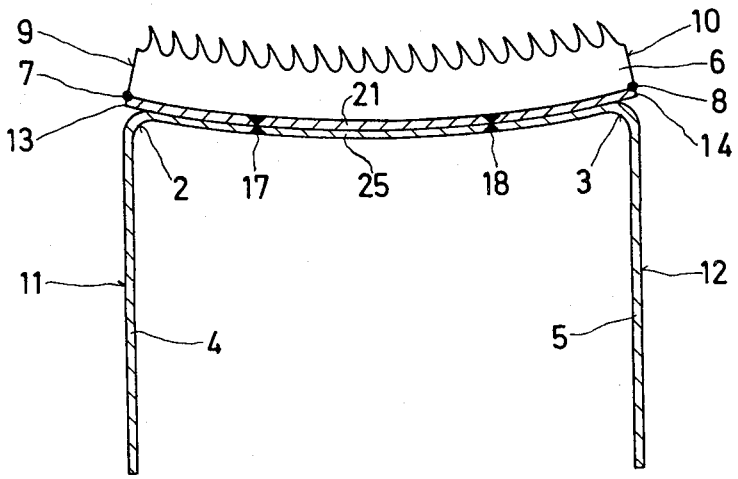
FIG. 6 is an embodiment of a curvilinearly extending iron profile which is connected to a bracket-shaped carrier.

FIG. 6 discloses an embodiment with a somewhat arc-shaped extending carrier member 21 which again is a rolled iron profile. The sawtooth wire sections 6 are welded in the area of their face ends 9, 10 by the agency of weld beads 7, 8 to the carrier member 21. This arrangement corresponds to such shown in FIG. 2. The carrier member 21 is welded by means of weldings 17, 18 to the base section 25 of an iron profile section having a bracket-shaped cross-sectional form. The base section 25 is followed again by curvilinear sections 2, 3 extending integrally to leg sections 4, 5. Again it can be seen that the longitudinal side faces 13, 14 of the carrier member 21 are aligned with the outer surfaces 11, 12 of the leg sections 4, 5.

All embodiments described above disclose clearly that no space at all is present between the flats of the revolving flat card between the sawtooth wire sections 6 such that accordingly no void spaces exist. It must be noted further that the shown and described embodiments can be manufactured in an extremely simple procedure and within relatively short time such that the card clothing can be manufactured faster and less costly than hitherto possible.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A card clothing intended to be mounted to the flats of a carding machine, comprising a plurality of wire sections of equal length provided with teeth and mounted onto a carrier member, wherein said carrier member is an elongated weblike rolled iron profile, and wherein the width of said iron profile equals the length of said wire sections and a plurality of said wire sections is welded by a common weld bead each extending along their ends to the longitudinally extending edge areas of said weblike iron profile, the section of each said wire sections extending intermediate said weld beads abutting directly said weblike iron profile, further wherein said weblike iron profile carrier member is mounted onto a further rolled iron profile having a bracket-like cross-sectional shape including a base section and two leg sections extending laterally thereto, which said leg sections are each connected via a curvilinear section to said base section, and wherein the longitudinal edges of said weblike carrier member are aligned each with the outer surfaces of said leg sections.

2. The card clothing of claim 1, wherein said weblike iron profile carrier member is a flat iron profile and said base section of said further iron profile is a flat profile section.

3. The card clothing of claim 1, wherein said weblike iron profile carrier member has a curvilinear cross-sectional shape and said base section of said further iron profile extends convexly into the area defined by itself and said leg section, whereby the curvilinear shape of said carrier member corresponds to the convex cross-sectional shape of said base section of said further iron profile.

4. A card clothing intended to be mounted to the flats of a carding machine, comprising a plurality of wire sections of equal length provided with teeth and mounted onto a carrier member comprising an elongated rolled flat iron profile, the width of which equals the length of said wire sections, each of said wire sections being welded at both its ends to the longitudinally extending edge areas of said iron profile, the section of each said wire section extending intermediate said welded areas directly abutting said carrier member, said carrier member being mounted onto a further rolled iron profile having a bracket-like cross-sectional shape including a base section and two leg sections extending laterally thereto, said leg sections each being connected via a curvilinear section to said base section, each of the longitudinal edges of said carrier member being aligned with the outer surfaces of said leg sections.

5. A card clothing intended to be mounted to the flats of a carding machine, comprising a plurality of wire sections of equal length provided with teeth and mounted onto a carrier member comprising an elongated rolled iron profile having a curvilinear cross-sectional shape the width of which equals the length of said wire sections, said wire sections located at the concavely extending side of said carrier member, with each of said wire sections being welded at both its ends to the longitudinally extending edge areas of said iron profile, the section of each wire sections extending intermediate said welded areas directly abutting said carrier member, said carrier member being connectively mounted onto a further rolled iron profile having a bracket-like cross-sectional shape including a base section and two leg sections extending laterally thereto, said leg sections each being connected, via a curvilinear section, to said base section, said base section extending convexly into the area defined by itself and said leg sections, each of the longitudinal edges of said carrier member being aligned with the outer side surface of said leg sections.

6. The card clothing of claim 4 or 5, wherein a plurality of said wire sections is welded to said edge areas of said iron profile by means of a common weld bead, each extending along said ends of said wire sections.

* * * * *